United States Patent [19]

Nishioka et al.

[11] 4,086,032

[45] Apr. 25, 1978

[54] SEALED TYPE MOTOR-COMPRESSOR

[75] Inventors: Kazumitsu Nishioka, Inazawa; Hiroshi Machida, Nagoya, both of Japan

[73] Assignee: Mitsubishi Jukogyo Kabushiki Kaisha, Tokyo, Japan

[21] Appl. No.: 716,797

[22] Filed: Aug. 23, 1976

[51] Int. Cl.[2] ..... F04B 17/00; F25B 39/04; F04B 35/00

[52] U.S. Cl. ..... 417/363; 62/508; 417/902

[58] Field of Search ..... 62/295, 296, 508; 417/312, 313, 363, 902; 285/237

[56] References Cited

U.S. PATENT DOCUMENTS

| | | | |
|---|---|---|---|
| 2,260,237 | 10/1941 | Stahl | 417/312 |
| 2,468,948 | 5/1949 | Smith | 417/902 |
| 3,311,292 | 3/1967 | Connor | 417/902 |
| 3,689,203 | 9/1972 | Vaughn | 417/363 |
| 3,817,661 | 6/1974 | Ingalls et al. | 417/312 |
| 3,870,440 | 3/1975 | Zuercher, Jr. | 417/902 |
| 3,902,629 | 9/1975 | Kushner | 417/902 |

*Primary Examiner*—Lloyd L. King
*Attorney, Agent, or Firm*—Cushman, Darby & Cushman

[57] ABSTRACT

A sealed type motor-compressor having such structure that a refrigerant gas is directly led from an intake pipe to a cylinder, is described herein. The sealed type motor-compressor is characterized in that between an intake pipe opening within a sealed housing and a gas inlet portion of a cylinder, is provided a connecting member which can slidably follow a relative movement in every direction of an internal component of said motor-compressor.

3 Claims, 5 Drawing Figures

Figure 2:
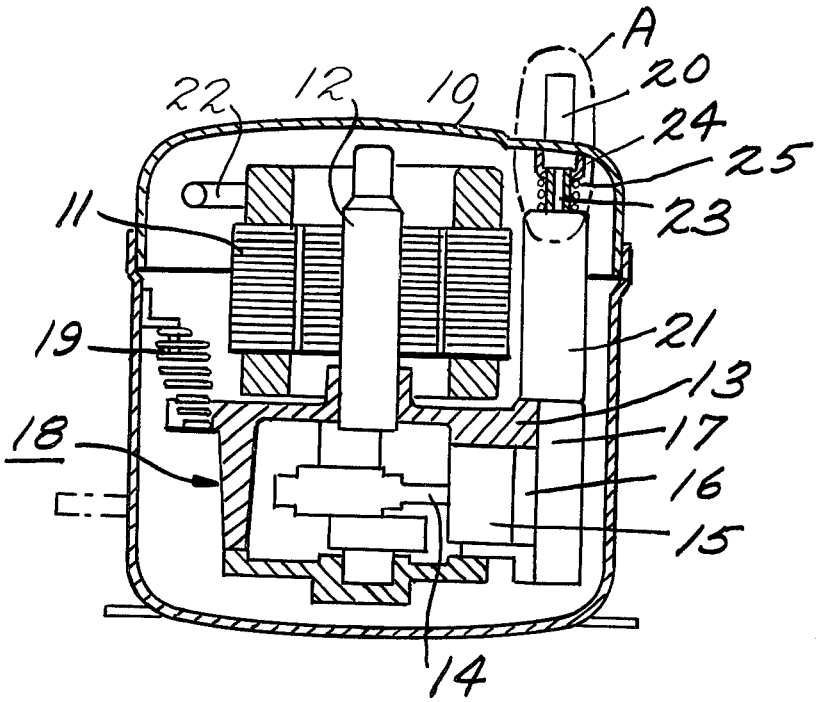

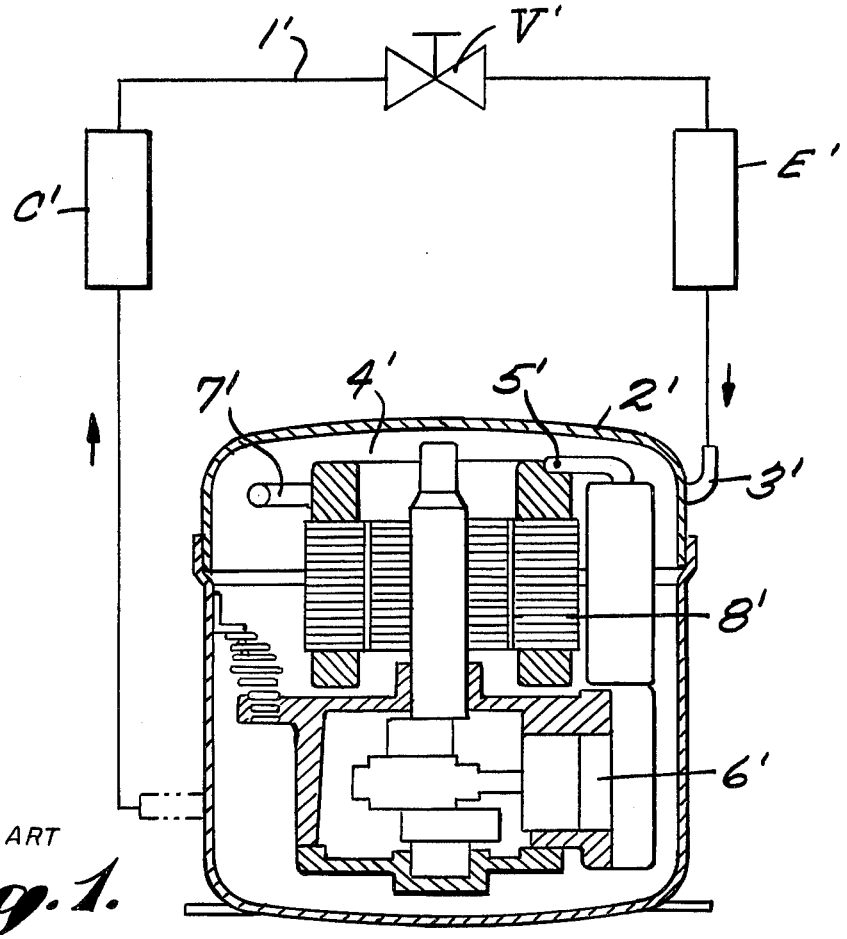
PRIOR ART
Fig. 1.
Fig. 4.
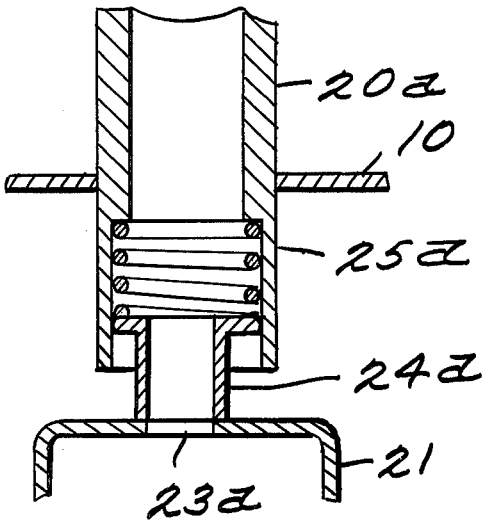
Fig. 5.
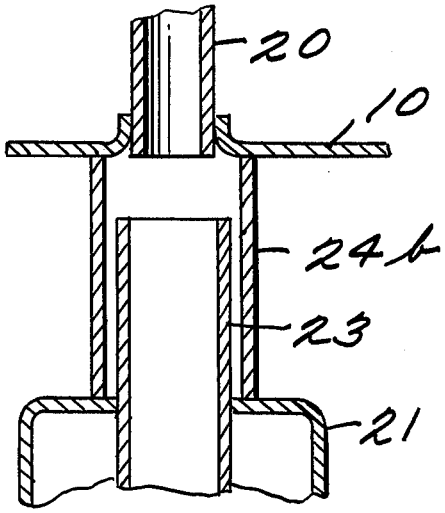

SEALED TYPE MOTOR-COMPRESSOR

The present invention relates to a sealed type motor compressor.

Heretofore, sealed type motor-compressors were constructed in such manner that a refrigerant gas which has finished a refrigerating cycle is led through an intake pipe to the interior of a sealed casing of the motor compressor and within said sealed casing the refrigerant gas is introduced through an inlet pipe into a cylinder chamber, where the refrigerant gas is compressed into a high-temperature and high-pressure gas and is again delivered through a delivery pipe into said refrigerating cycle.

However, in such a prior art apparatus, the refrigerant gas fed back to the motor-compressor would be heated up within the sealed casing by high-temperature portions of a motor or a delivery refrigerant gas pipe, so that the refrigerant gas just before entrance into the cylinder takes a high temperature, resulting in disadvantages such that the compression work is increased and that owing to lowering of a specific gravity of the refrigerant gas the amount of refrigerant gas sucked into the cylinder chamber for a given stroke of the cylinder is reduced.

In order to eliminate these disadvantages, various provisions were made such that the intake pipe for the motor-compressor was directly connected to an intake muffler of a cylinder or to a cylinder head, and that within the sealed casing the intake opening of the intake muffler of the cylinder is disposed as opposed to the tip end of the intake pipe at the minimum distance. However, even with such modifications, the motor-compressors in the prior art were still not acceptable, because of various fatal disadvantages such that transmission of vibration from the compressor to external pipings was increased and that prevention of overheating of an intake refrigerant gas for the cylinder was not sufficient.

Therefore, it is a principal object of the present invention to provide a novel sealed type motor-compressor that is free from all the disadvantages of the sealed type motor-compressors in the prior art.

Another object of the present invention is to provide a novel refrigerant gas intake system for a sealed type motor-compressor, which reduces overheating of an intake refrigerant gas caused within a sealed casing of the motor-compressor to the minimum, and which has little transmission of vibration from the compressor to external pipings.

According to one feature of the present invention, there is provided a sealed type motor compressor having such structure that a refrigerant gas is directly led from an intake pipe to a cylinder, characterized in that between an intake pipe which opens within a sealed housing and a gas inlet portion of a cylinder, is provided a connecting member which can slidably follow a relative movement in every direction of an internal component of said motor compressor.

Figure 3:
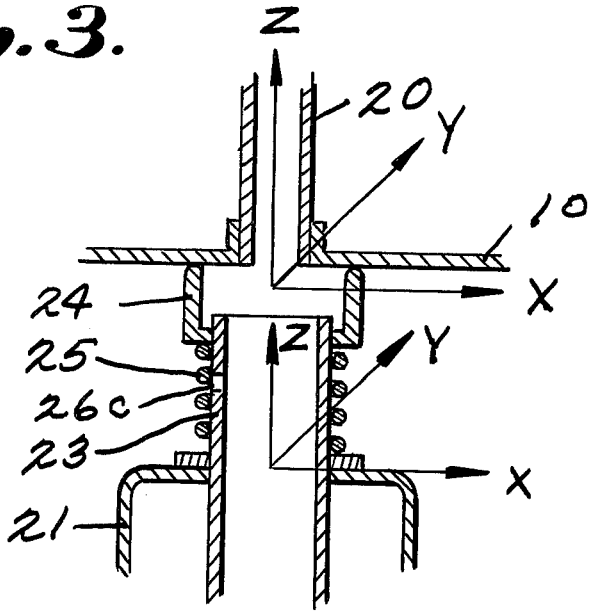

Above-mentioned and other features and objects of this invention will become more apparent by reference to the following description taken in conjunction with the accompanying drawings, in which:

FIG. 1 is a front view partly in longitudinal cross-section showing an outline of a sealed type motor-compressor in the prior art, FIG. 2 is a front view partly in longitudinal cross-section of one preferred embodiment of the present invention, FIG. 3 is an enlarged longitudinal cross-section view showing the structure of the essential part A in FIG. 2, FIGS. 4 and 5 are enlarged longitudinal cross-section views of the essential part A in FIG. 2 according to modified embodiments, respectively.

Now the invention will be described in more detail with reference to FIGS. 2 through 5. However, before entering the description of the present invention, it will be useful for better understanding the present invention to explain in detail the structures and disadvantages of the sealed type motor-compressors in the prior art with reference to FIG. 1. In general, in a sealed type motor-compressor in the prior art as exemplified in FIG. 1, a refrigerant gas which has finished a refrigerating cycle represented, as a whole, by reference numeral 1′ (C′ representing a condenser, V′ representing an expansion valve, and E′ representing an evaporator) and has been fed back to a sealed type motor compressor 2′, is led through an intake pipe 3′ of the motor-compressor 2′ into an interior 4′ of the motor-compressor, and is passed through an inlet pipe 5′ into a cylinder chamber 6′, where the refrigerant gas is compressed into a high-temperature high-pressure gas, and then delivered through a delivery pipe 7′ to said refrigerating cycle 1′.

In the above-described motor-compressor in the prior art, even though the temperature of the refrigerant gas which has finished a refrigerating cycle and has returned to the motor-compressor is at a room temperature, after it has entered the interior 4′ of the casing, it will be heated up by a high temperature portions of a motor 8′ and the delivery pipe 7′, so that the temperature of the refrigerant gas just before entrance into the cylinder chamber 6′ becomes high. Consequently, the prior art apparatus had disadvantages such that the compression work was increased and that the amount of the refrigerant gas sucked into the cylinder chamber for each stroke was reduced, due to lowering of a specific gravity of the refrigerant gas. In order to improve these disadvantages various provisions have been heretofore proposed, and these proposals are classified into two classes, but either one of them had the following disadvantages:

(I) According to one of the classes, an intake pipe for a motor-compressor is sealingly connected to an intake muffler or to a cylinder head (for instance, Japanese Utility Model Publication No. 43-22776, Japanese Utility Model Laid-Open Specification No. 49-104002, and Japanese Utility Model Publication No. 43-20394), but in this class of structure a sufficiently large diameter of an intake pipe is necessitated so as not to greatly increase a pipe friction loss of the intake gas, so that an elastic constant of the intake pipe is necessarily greatly increased. Then the transmission of vibration from the compressor to an external piping is enhanced, and though use of a flexible tube was proposed, this proposal is almost not practically employed because of increase in cost and in size .

(II) According to another class, an inlet portion of an intake muffler is opened as opposed to the tip end of the intake pipe at the minimum distance so that the refrigerant gas may be directly sucked into the muffler (for instance, Japanese Utility Model Publication No. 49-22567, Japanese Utility Model Laid-Open Specification No. 49-13408, Japanese Utility Model Publication No. 36-2981, and Japanese Utility Model Publication No. 37-32286, and according to this proposal, the above-mentioned fatal disadvantage of increase of vibration transmission may be eliminated, but the effect of preventing the intake gas from over-heating is insufficient because the intake pipe for the motor-compressor and the cylinder are not sealingly connected by pipes.

Now a first preferred embodiment of the present invention will be described with reference to FIGS. 2 and 3. In these figures, reference numeral 10 designates a sealed housing of a motor-compressor, and within said sealed housing 10 is resiliently supported by supporting springs 19 an internal component 18 consisting of an electric motor 11, a crank shaft 12, a crank case 13, a connecting rod 14, a piston 15, a cylinder 16, a cylinder head 17, etc. In addition, reference numeral 20 designates an intake pipe for the motor-compressor, numeral 21 designates an intake muffler, and numeral 22 designates a delivery pipe. The above-mentioned intake pipe 20 opens within the sealed housing 10. At a position opposed to said opening portion of the intake pipe 20 is disposed an intake pipe 23 of an intake muffler 21 which communicates with the cylinder 16, and along an outer periphery of said intake pipe 23 is mounted a slidable tube 24, which is adapted to tightly abut against the inner surface of the sealed housing 10 while covering said opening portion of the intake pipe 20 owing to a resilient force of a coil spring 25. It is only necessary to retain a minimum slidable gap clearance between the intake pipe 23 and the slidable tube 24. With regard to an orifice designated by numeral **26*c* in FIG. 3**, its function will be explained later.

The operation of the above-described sealed type motor compressor will be explained hereunder. As described above, since the slidable tube 24 connects the intake pipe 20 and the intake pipe 23 of the intake muffler 21 to form an intake gas passageway, since it is tightly abutted against the inner surface of the sealed housing 10 owing to the coil spring 25 mounted and compressed between the intake muffler 21 and the slidable tube 24, and since the slidable tube 24 and the intake pipe 23 are mutually slidable, the intake gas passageway formed by said intake pipe 20, slidable tube 24 and intake pipe 23 is separated from the high-temperature portions within the sealed housing 10 such as the electric motor 11, the delivery pipe 22, etc. Accordingly, the intake gas can be directly sucked into the intake muffler 21 without contacting to said high-temperature portions.

In response to a movement in the X-direction (See FIG. 3) of the internal component 18 that is resiliently supported within the sealed housing 10 by means of the supporting springs 19, the slidable tube 24 will slide along the inner surface of the sealed housing 10 as tightly contacting thereto, and in response to a movement in the Z-direction (See FIG. 3) the coil spring 25 will be elongated or contracted and the slidable tube 24 will slide along the surface of the intake pipe 23. In addition, in response to a movement in the Y-direction (an oblique direction), the abovementioned two actions will arise in combination, and so, eventually, transmission of vibration involving a relative movement in every direction from the internal component 18 can be prevented, so that the internal component 18 can be resiliently supported in an effective manner.

The structure of the essential part shown at A in FIG. 2 could be modified as follows: That is, as shown in FIG. 4 the structure could be modified such that an intake pipe **20*a* is made to project inside of a sealed housing 10, a slidable tube 24*a* is slidably mounted within the projecting portion of said intake pipe 20*a* and said slidable tube 24*a* is urged against an intake muffler 21 by means of a coil spring 25*a* so that the slidable tube 24*a* may cover an opening portion 23*a* of the intake muffler 21 and may make tight contact with said intake muffler 21**.

Or else, as shown in FIG. 5 the structure could be modified such that a slidable tube **24*b* itself is formed as a flexible tube, and thereby not only the slidable tube 24*b* can follow a relative movement in the slidable direction of an internal component 18 but also it can follow a relative movement in an unslidable direction of the internal component 18 owing to the flexibility of the slidable tube 24*b*** itself.

For an action of feeding back a high-pressure gas leaking out through the gap clearance between the piston 15 and the cylinder 16, that is, the so-called blow-by gas to the intake side, the sliding gap clearance of said slidable tube is utilized. However, in order to minimize this gap clearance, a small orifice **26*c* could be provided separately in the intake pipe 23 of the intake muffler 21 as shown in FIG. 3**.

In essence, the sealed type motor-compressor according to the present invention is characterized in that in a sealed type motor-compressor having such structure that a refrigerant gas is directly led from an intake pipe to a cylinder, between an intake pipe (20, **20*a* ) which opens within a sealed housing and a gas inlet portion of a cylinder (16) is provided a connecting member, and said connecting member is slidably mounted so that it may follow a relative movement in every direction of an internal component (18**) of the motor-compressor.

More particularly, according to the present invention, a sealed type motor-compressor is provided with a connecting member between an intake pipe which opens within a sealed housing and a gas inlet portion of a cylinder; for instance, a connecting member consisting of a slidable tube 24 slidably mounted around an outer periphery of the intake pipe and a coil spring 25 which urges said slidable tube tightly against an inner surface of the housing so as to cover the opening portion of the intake pipe 20 as described above in connection to the first embodiment in FIG. 3; a connecting member constructed in such manner that a slidable tube **24*a* is slidably mounted within an intake pipe 20*a* itself which projects to the interior of the housing and said slidable tube 24*a* is urged by a coil spring 25*a* so that said slidable tube 24*a* may cover an opening portion 23*a* of an intake muffler and may make tight contact with the intake muffler as described above in connection to the second embodiment in FIG. 4; or a connecting member consisting of a slidable tube 24*b* itself which is formed as a flexible tubular body as described above in connection to the third embodiment in FIG. 5. Said connecting member is slidably mounted so that it can follow a relative movement in every direction of an internal component 18** of the motor-compressor, and the intake gas passageway including said connecting member is in an isolated state within the sealed housing of the motor-compressor.

Consequently, the sealed type motor compressors according to the present invention have the following remarkable advantages:

(i) Since an intake gas is directly sucked into a muffler without making direct contact with high-temperature portions such as an electric motor, a gas delivery pipe, etc. within a sealed housing, overheating of the intake gas can be prevented. Accordingly, (a) energy required for compression of the refrigerant gas can be saved, and (b) a density of gas introduced into a cylinder is increased resulting in corresponding improvement in a volume efficiency, and thereby the compressor can be small-sized.

(ii) Since said connecting member can follow a relative movement in every direction of the motor-compressor, impacts and vibrations upon transportation of the motor-compressor can be fully absorbed. And also, since the opening of the intake muffler within the sealed housing is sufficiently small, pulsations within said housing are small and a silencing effect for a motion sound is obtained.

(iii) In addition, owing to the fact that upon starting the flow rate of the regrigerant within the sealed housing flowing into the muffler through the gap clearance formed by said slidable tube is minimized by urging said connecting member with a spring force as described above or by providing a slidable tube having flexibility by itself, the following effects can be achieved:

(a) Since a refrigerant pressure within the intake muffler is abruptly lowered, loading upon starting can be reduced.

(b) By mitigating a pressure lowering speed within the sealed housing, abnormal sounds or destruction of the cylinder caused by liquid compression within the cylinder, can be prevented.

(iv) Though it is necessary to feed back a high-pressure gas (blow-by gas) leaking out through the gap clearance between the piston and the cylinder to the intake side, this can be accomplished by merely adjusting a slide gap clearance of the slidable tube of the connecting member or by providing a small orifice in the intake pipe as described above, and therefore, this adjustment is very simple.

Since many changes could be made in the above construction and many apparently widely different embodiments of this invention could be made without departing from the scope thereof, it is intended that all matter contained in the above description or shown in the accompanying drawings shall be interpreted as illustrative and not in a limiting sense.

What is claimed is:

1. A motor-compressor for refrigerant gas having a sealed housing including a gas compressing means and motor means for driving said gas compressing means mounted in said housing, said housing having a gas inlet and conduit means for connecting said gas inlet to said gas compressing means while isolating gas passed through said gas inlet from said motor means, said conduit means including a first tube mounted in said housing, a second tube having one end slidably mounted on said first tube and the other end surrounding said gas inlet and spring means disposed to constantly urge said second tube toward said gas inlet.

2. A motor-compressor for refrigerant gas having a sealed housing including a gas compressing means and motor means for driving said gas compressing means mounted in said housing, said housing having a gas inlet and conduit means for connecting said gas inlet to said gas compressing means while isolating gas passed through said gas inlet from said motor means, said conduit means including a muffler having an opening, a tube having one end surrounding said opening and its other end extending into said gas inlet, spring means acting between said gas inlet and said tube to constantly urge said tube toward said opening in said muffler.

3. A motor-compressor as claimed in claim 1 wherein said gas compressing means and said motor means for driving said gas compressing means are resiliently mounted in said housing.

* * * * *